US011538625B2

(12) United States Patent
Wang et al.

(10) Patent No.: US 11,538,625 B2
(45) Date of Patent: Dec. 27, 2022

(54) COIL DEVICE

(71) Applicant: Wuxi TDK-Lambda Electronics Co. Ltd, Wuxi (CN)

(72) Inventors: YueQing Wang, Wuxi (CN); Honglei Wang, Wuxi (CN)

(73) Assignee: WUXI TDK-Lambda Electronics Co. Ltd, Wuxi (CN)

( * ) Notice: Subject to any disclaimer, the term of this patent is extended or adjusted under 35 U.S.C. 154(b) by 634 days.

(21) Appl. No.: 16/557,445

(22) Filed: Aug. 30, 2019

(65) Prior Publication Data

US 2020/0075231 A1 Mar. 5, 2020

(30) Foreign Application Priority Data

Sep. 3, 2018 (CN) ..... 201811019853.4

(51) Int. Cl.

| | |
|---|---|
| ***H01F 27/32*** | (2006.01) |
| ***H01F 41/04*** | (2006.01) |
| ***H01F 27/24*** | (2006.01) |
| ***H01F 27/28*** | (2006.01) |

(52) U.S. Cl.

CPC ..... *H01F 27/325* (2013.01); *H01F 27/24* (2013.01); *H01F 27/28* (2013.01); *H01F 41/04* (2013.01)

(58) Field of Classification Search

CPC ..... H01F 27/325; H01F 27/24; H01F 27/28; H01F 41/04; H01F 3/14; H01F 27/306; H01F 27/34; H01F 27/263; H01F 27/2823; H01F 41/00; H01F 41/06; H01F 5/02; H01F 5/06

See application file for complete search history.

(56) References Cited

U.S. PATENT DOCUMENTS 4,716,394 A * 12/1987 Gordon ..... H01F 27/325 336/198
9,666,355 B1 * 5/2017 Folker ..... H01F 27/33
10,003,275 B2 6/2018 Chen
(Continued)

FOREIGN PATENT DOCUMENTS

JP H05-48313 U 6/1993
JP 2001-023832 A 1/2001
(Continued)

*Primary Examiner* — Mang Tin Bik Lian
(74) *Attorney, Agent, or Firm* — Oliff PLC

(57) ABSTRACT

A coil device includes a bobbin including a hollow cylindrical portion and first and second flanges disposed at ends of the hollow cylindrical portion, and having a first partition located between the first and second flange and a second partition located between the first partition and second flange; the first winding wound around the outer periphery of the hollow cylindrical portion between first partition and the first flange; the second winding wound around the outer peripheral surface of the hollow cylindrical portion between the first partition and the second flange, and wound around both sides of the second partition according to a predetermined position. The coil device can wind the winding wire of the second winding at a predetermined position, thereby reinforcing the secondary side magnetic coupling while controlling or reducing the leakage inductance manufacturing error between the primary and secondary side due to difference in the secondary side winding.

8 Claims, 5 Drawing Sheets

(56) References Cited

U.S. PATENT DOCUMENTS

| | | | | |
|---|---|---|---|---|
| 2005/0140485 | A1* | 6/2005 | Chang | H01F 27/325 336/198 |
| 2009/0278646 | A1 | 11/2009 | Chen et al. | |
| 2009/0295530 | A1* | 12/2009 | Faccin | H01F 27/325 336/220 |
| 2011/0037554 | A1* | 2/2011 | Tsai | H01F 27/325 336/208 |
| 2013/0328654 | A1* | 12/2013 | Iwakura | H01F 27/006 336/196 |
| 2015/0061808 | A1* | 3/2015 | Iwakura | H01F 27/346 336/178 |
| 2016/0329148 | A1* | 11/2016 | Iwakura | H01F 27/24 |
| 2017/0367184 | A1* | 12/2017 | Wang | H05K 3/306 |
| 2019/0139697 | A1* | 5/2019 | Lu | H01F 41/04 |

FOREIGN PATENT DOCUMENTS

| | | | | | |
|---|---|---|---|---|---|
| JP | 2005-142458 | A | | 6/2005 | |
| JP | 3216430 | U | * | 5/2018 | H01F 27/02 |
| JP | 3216430 | U | | 5/2018 | |

* cited by examiner

COIL DEVICE

BACKGROUND

(a) Field

The present invention relates to a coil device and the like, and more particularly, to a coil device and the like in which a plurality of winding portions are wound and applied to a switching power supply.

(b) Description of the Related Art

Patent Document 1 proposes a coil device in which a partition portion is provided on the outer peripheral surface of the bobbin, the primary side winding is formed on one side of the partition portion, and the secondary side winding is formed on the other side (see Patent Document 1). Such a coil device has a configuration that is advantageous for thinning.

Patent Document 1: Japanese Utility Model Application Publication No. H5-48313.

However, in the coil device described above, when multiple coils are wound on the secondary side, it is difficult for the secondary winding to be wound at a predetermined position, resulting in weakening of the magnetic coupling on the secondary side.

SUMMARY

In view of such a practical situation, the present invention relates to a coil device in which a secondary side winding is wound at a predetermined position and magnetic coupling on the secondary side is reinforced. In order to achieve the above object, the coil device of the present invention comprises:

a bobbin including a hollow cylindrical portion and a first flange portion and a second flange portion disposed at both ends of the hollow cylindrical portion, and having a first partition portion located between the first and second flange portion and a second partition portion located between the first partition portion and the second flange portion on the hollow cylindrical portion;

the first winding portion wound around the outer peripheral surface of the hollow cylindrical portion provided between first partition portion and the first flange portion;

the second winding portion wound around the outer peripheral surface of the hollow cylindrical portion provided between the first partition portion and the second flange portion, and wound around both sides of the second partition portion according to a predetermined position.

The coil device according to the present invention has a structure in which the first winding portion and the second winding portion are respectively wound around both sides of the first partition portion, and the winding of the second winding portion is wound at a predetermined position on both sides of the second partition portion. With such a winding configuration, the second winding portion can be easily wound at a predetermined position, thereby effectively controlling or reducing the leakage inductance manufacturing error between the primary side and the secondary side due to the difference in the secondary side winding, and at the same time strengthening the magnetic coupling on one side of the second winding portion.

Further, in the coil device according to the present invention, the second partition portion has an opening portion for winding the second winding portion on both sides of the second partition portion at a predetermined position. With such a configuration, the second winding portion can be easily wound on both sides of the second partition portion, without causing high elevation of the coil due to wire extraction.

Further, in the coil device according to the present invention, the first support member and the second support member that are opposed to each other with the bobbin and the first and second winding portions interposed therebetween may be provided.

The first partition portion is a first wall of the first partition portion and a second wall of the first partition portion provided on an outer peripheral surface of the hollow cylindrical portion via a gap.

The first support member and the second support member may be inserted into the gap between the first wall of the first partition portion and the second wall of the first partition portion to be mated to each other.

By adopting such a configuration, the first support member and the second support member can be used as the outer casing to protect the winding of the first winding portion and the second winding portion.

Further, in the coil device according to the present invention, the first support member and the second support member have an insulating wall extending an insulation distance between the first winding portion and the second winding portion in a direction toward a mounting surface of the coil device. By adopting such a configuration, the insulation distance between the first winding portion and the second winding portion can be increased.

Further, in the coil device according to the present invention, the first support member and the second support member have an L-shaped structure which is interlaced with each other as viewed in the direction towards the mounting surface of the coil device. By adopting such a configuration, the insulation distance between the first winding portion and the second winding portion can be further increased.

Further, in the coil device according to the present invention, the first support member and the second support member have completely the same shape. With such a configuration, the first support member and the second support member can be manufactured by using one mold, thereby saving manufacturing costs.

Further, in the coil device according to the present invention further comprising first and second core portions insertable into the hollow cylindrical portion, the first and second core portions are joined via a gap. With such a configuration, the magnetic coupling of the first winding portion and the second winding portion can be improved.

Further, in the coil device according to the present invention, the second winding portion is wound by a plurality of windings. With such a configuration, the magnetic coupling on the side of the second winding portion can be enhanced.

A method of manufacturing the coil device of the present invention comprising:

preparing a bobbin having a first partition portion and a second partition portion on the outer peripheral surface;

forming a first winding portion on the outer peripheral surface of one side of the first partition portion, forming a second winding portion at a predetermined position on both sides of the second partition portion on the outer peripheral surface on the other side of the first partition portion.

Preferably, in the step of forming the second winding portion at a predetermined position on both sides of the second partition portion, the second winding portion is sequentially wound around one side and the other side of the second partition portion.

With the above manufacturing method, it is possible to obtain a coil device in which the magnetic coupling on the side of the second winding portion is enhanced and the leakage inductance manufacturing error between the primary side and the secondary side due to the difference in the secondary side winding is effectively controlled or reduced.

DETAILED DESCRIPTION OF EMBODIMENTS

Figure 1:
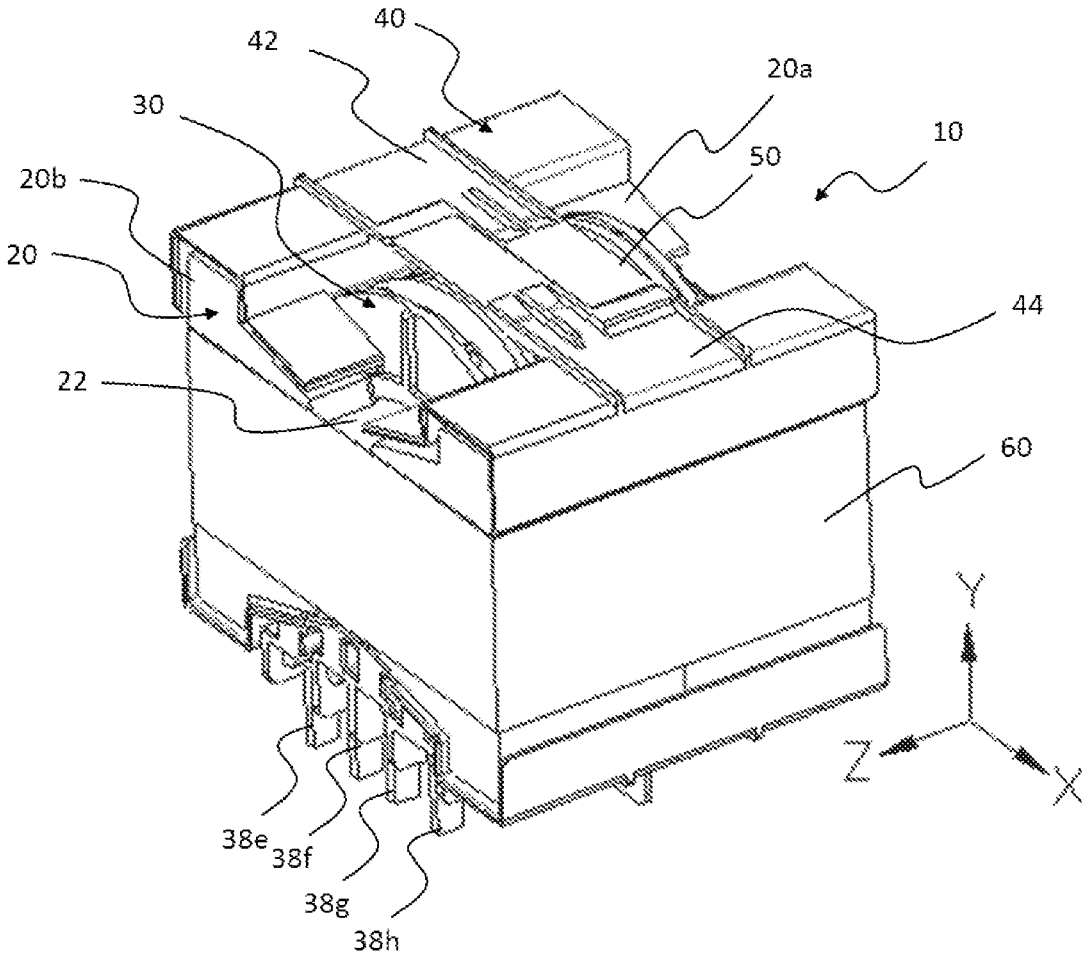
FIG. 1 is an overall perspective view of a coil device according to a first embodiment of the present invention.

FIG. 1 is a perspective view of a coil device 10 according to a first embodiment of the present invention. The coil device 10 has a magnetic core 20, a bobbin 30, a support 40, a coil body 50, an insulating tape 60, and the like. The coil device 10 is a horizontal coil device in which the axial direction of the central shaft portion 22 of the magnetic core 20 is parallel to the mounting surface of the coil device 10, but the coil device according to the present invention is not limited to the horizontal type, and may be a vertical coil device in which the axial direction of the central shaft portion is parallel to the normal to the mounting surface.

In addition, in the description of the coil device 10 according to the embodiment, as shown in FIG. 1, the axial direction of the central shaft portion 22 of the magnetic core 20 is a Z-axis direction, and the normal direction of the mounting surface is a Y-axis direction, the direction perpendicular to the Z-axis direction and the Y-axis direction is an X-axis direction.

Figure 2:
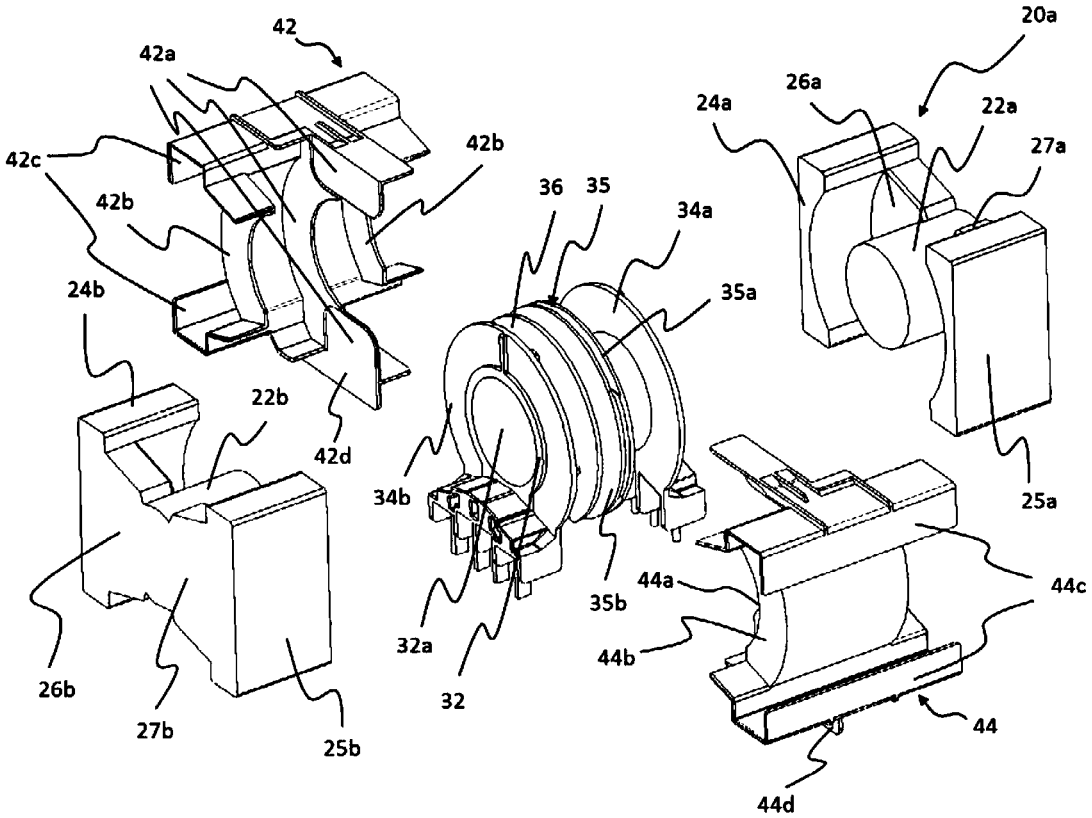
FIG. 2 is an exploded perspective view showing a magnetic core, a bobbin, and a support member included in the coil device shown in FIG. 1.

FIG. 2 is an exploded perspective view of the coil device 10. Further, the coil body 50 and the insulating tape 60 are not shown in FIG. 3. The bobbin 30 has a hollow cylindrical portion 32 in which a through hole 32*a* of the central shaft portion 22 of the magnetic core 20 is formed. In addition, a first flange portion 34*a* and a second flange portion 34*b* protruding in the radial direction from the hollow cylindrical portion 32 are provided at both ends of the hollow cylindrical portion 32.

A first partition portion 35 positioned between the first flange portion 34*a* and the second flange portion 34*b* and a second partition portion 36 positioned between the first partition portion 35 and the second flange portion 34*b* are provided on the hollow cylindrical portion 32. The first partition portion 35 is a first wall 35*a* of the first partition portion and a second wall 35*b* of the first partition portion provided on the outer peripheral surface of the hollow cylindrical portion 32 via the gap The coil device 10 further includes a first support member 42 and a second support member 44 that are inserted into the bobbin 30 and the coil body 50 and disposed opposite to each other. The first support member 42 and the second support member 44 are insertable into the gap between the first wall 35*a* of the first partition portion and the second wall 35*b* of the first partition portion to be mated to each other. The first support member 42 includes an insertion portion 42*a* capable of being inserted into a gap between a first wall 35*a* of the first partition portion and a second wall 35*b* of the first partition portion, a surrounding portion 42*b* surrounding the coil body 50, and a flange portion 42*c* for positioning side leg portions 24, 25 (which will be described later) of the magnetic core 20. The second support member 44 includes an insertion portion 44*a* capable of being inserted into a gap between the first wall 35*a* of the first partition portion and the second wall 35*b* of the first partition portion, a surrounding portion 44*b* surrounding the coil body 50, and a flange portion 44*c* for positioning side leg portions 24, 25 (which will be described later) of the magnetic core 20. Further, the first support member 42 and the second support member 44 have insulating walls 42*d*, 44*d* that extend the insulation distance between the first winding portion 52 and the second winding portion 54 (which will be described later) of the coil body 50 in the direction toward the mounting surface of the coil device 10, and the depth of the insulating walls 42*d*, 44*d* in the −Y direction may extend, for example, to the mounting surface of the coil device 10 (for example, on a mounting substrate). Here, the distance of the gap between the first wall 35*a* of the first partition portion and the second wall 35*b* of the first partition is, for example, slightly larger than the total value of the wall thicknesses of the insertion portion 42*a* of the first support member 42 and the insertion portion 44*a* of the second support member 44. Thereby, the first support member 42 and the second support member 44 can be positioned by inserting the insertion portions 42*a*, 44*a* into the gap between the first wall 35*a* of the first partition portion and the second wall 35*b* of the first partition portion.

Figure 3:
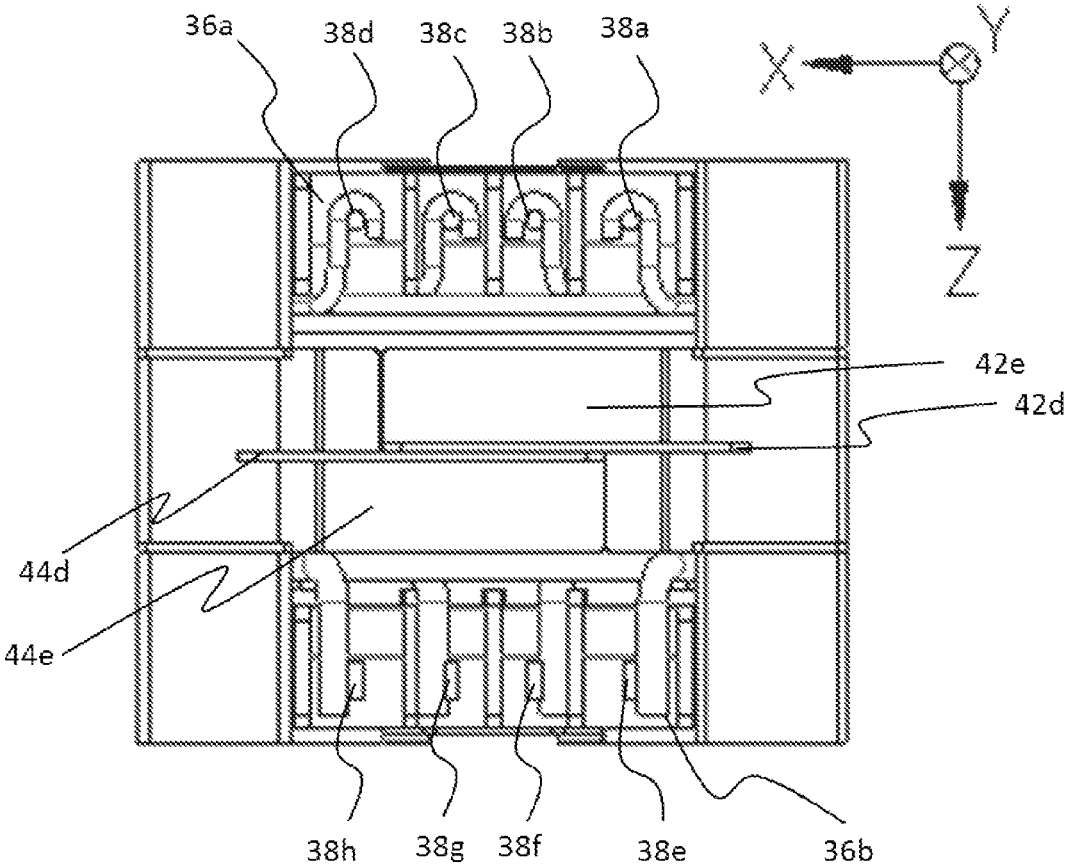
FIG. 3 is a bottom view of the coil device shown in FIG. 1.

FIG. 3 is a bottom view of the coil device shown in FIG. 1. The first support member 42 and the second support member 44 have L-shaped cross-sectional structures 42*e*, 44*e* which are interlaced with each other as viewed in the direction towards the mounting surface of the coil device 10. Further, the first support member 42 and the second support member 44 may have an L-shaped cross-sectional shape which is interlaced with each other as viewed towards a top surface direction opposite to the mounting surface. Further, the first support member 42 and the second support member 44 may have the same shape. Thereby, the first support member 42 and the second support member 44 can be manufactured with one mold, and the manufacturing cost can be reduced.

A first terminal block portion 36*a* is connected to the first flange portion 34*a*, and the terminal portions 38*a*, 38*b*, 38*c*, and 38*d* are provided on the first terminal block portion 36*a*. A second terminal block portion 36*b* is connected to the second flange portion 34*b*, and as shown in FIG. 3 which is a bottom view, the terminal portions 38*e*, 38*f*, 38*g*, and 38*h* are provided on the second terminal block portion 36*b*. As shown in FIG. 1 and FIG. 2, the first terminal block portion 36*a*, the second terminal block portion 36*b*, and the terminal portions 38*a* to 38*h* are connected to the end portion of Y-axis negative-direction of the coil device 10, and the coil device 10 is provided on the mounting substrate via the terminal portions 38*a* to 38*h*.

The material of the bobbin 30 is not particularly limited, and is preferably made of an insulating material such as a resin, and it is preferable to use, for example, a phenol resin or the like from the viewpoint of heat resistance during welding or the like.

As shown in FIG. 2, the magnetic core 20 has two core portions 20*a*, 20*b* which are formed in a separated state, and the magnetic core 20 is formed by joining the two core portions 20*a*, 20*b* at the central portion in the Z-axis direction. The core portion 20*a* has a central shaft portion 22*a*, side leg portions 24*a*, 25*a*, and connecting portions 26*a*, 27*a*. The core portion 20*b* has a central shaft portion 22*b*, side leg portions 24*b*, 25*b*, and connecting portions 26*b*, 27*b*.

The central shaft portion 22 is disposed at the central portion in the X-axis direction of the coil device 10, passes through the through hole 32*a* formed in the hollow cylindrical portion 32 of the bobbin 30, and extends in the Z-axis direction. A central gap 28 is formed at a central portion of the central shaft portion 22 in the Z-axis direction, that is, at a position corresponding to the joint portion of the core portion 20*a* and the core portion 20*b* (refer to FIG. 5). The center gap 28 is formed by bringing the two core portions 20*a*, 20*b* formed in a separated state into contact with each other, but may be formed by sandwiching a gap material or the like. In addition, in the joint portion between the core portion 20*a* and the core portion 20*b*, even in a state in which nothing is sandwiched between the two as shown in the embodiment, a gap as a magnetic path can be generally formed. However, if the mirror-polished surfaces are joined to each other after mirror-polishing the joint surfaces of both sides, there is also a case where no gap is formed at the joint portion.

The side leg portions 24*a* and 25*a* of the core portion 20*a* sandwich the central shaft portion 22 and are placed on both sides in the X-axis direction. The side leg portions 24*a*, 25*a* extend in the Z-axis direction so as to be substantially parallel to the central shaft portion 22*a*. The side leg portions 24*b*, 25*b* of the core portion 20*b* sandwich the central shaft portion 22*b* and are placed on both sides in the X-axis direction. The side leg portions 24*b*, 25*b* extend in the Z-axis direction so as to be substantially parallel to the center shaft portion 22*b*. The central portion of the side leg portions 24*a*, 24*b*, 25*a*, 25*b* in the Z-axis direction is formed with a side gap.

The connecting portions 26*a*, 27*a* of the core portion 20*a* sandwich the hollow cylindrical portion 32 of the bobbin 30 and are disposed on both sides in the Z-axis direction, and connect the end portions of the central shaft portion 22*a* and the side leg portions 24*a*, 25*a*. The connecting portions 26*b*, 27*b* of the core portion 20*b* sandwich the hollow cylindrical portion 32 of the bobbin 30 and are disposed on both sides in the Z-axis direction, and connect the end portions of the central shaft portion 22*b* and the side leg portions 24*b*, 25*b*. A magnetic circuit having a loop passing through the central shaft portion 22*a*, 22*b* and connecting portions 26*a*, 26*b* and side leg portions 24*a*, 24*b*, and a loop passing through the central shaft portion 22*a*, 22*b*, the connecting portions 27*a*, 27*b* and the side leg portions 24*a*, 24*b* is formed on the magnetic core 20.

The material of the magnetic core 20 is not particularly limited, it is composed of a soft magnetic material such as such as ferrite or a permalloy (permalloy) or a magnetic material of metal powder compacting, etc.

As shown in FIG. 1, the two core portions 20*a*, 20*b* are joined by winding the insulating tape 60 around the outer periphery. As the insulating tape 60, the adhesive tape or the like which uses an insulating resin as a base material can be used, but the material is not particularly limited. Also, the two core portions 20*a*, 20*b* may be bonded to each other using an adhesive.

Figure 4:
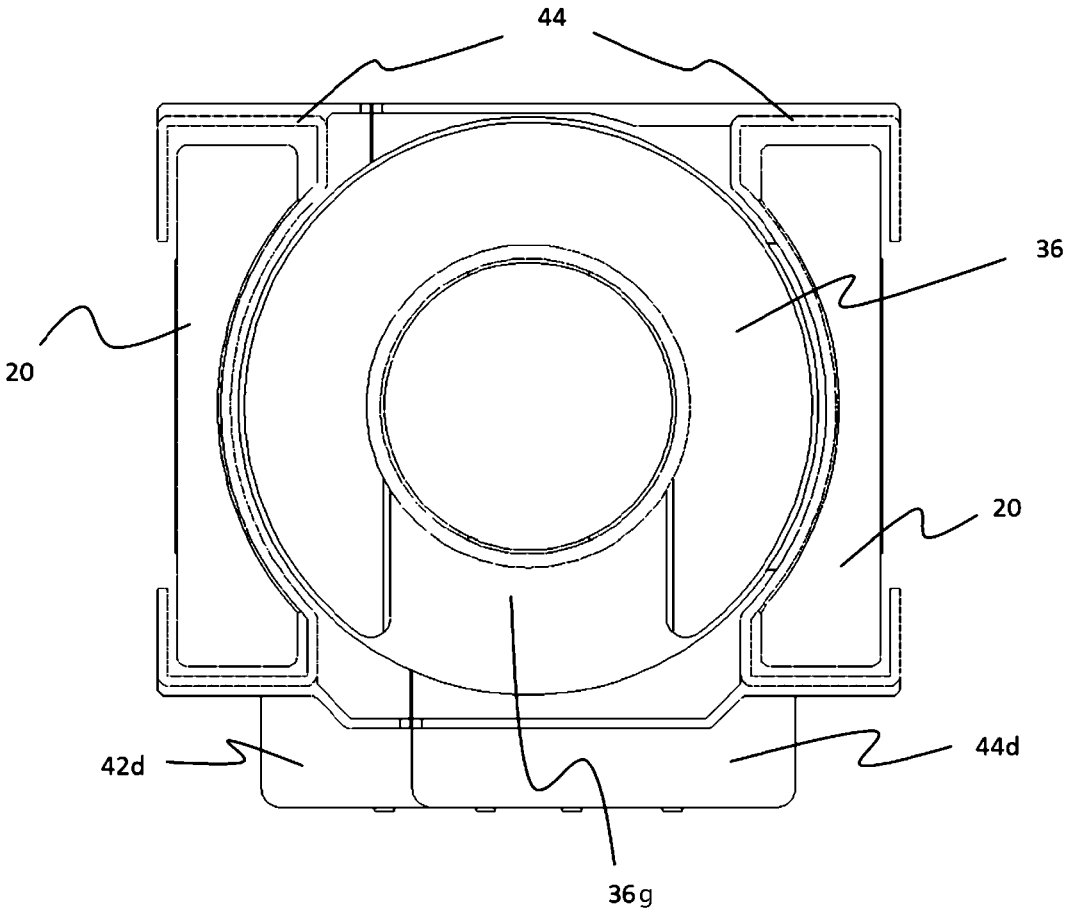
FIG. 4 is a cross-sectional view taken along a plane on which the second partition in the coil device shown in FIG. 1 is located.
Figure 5:
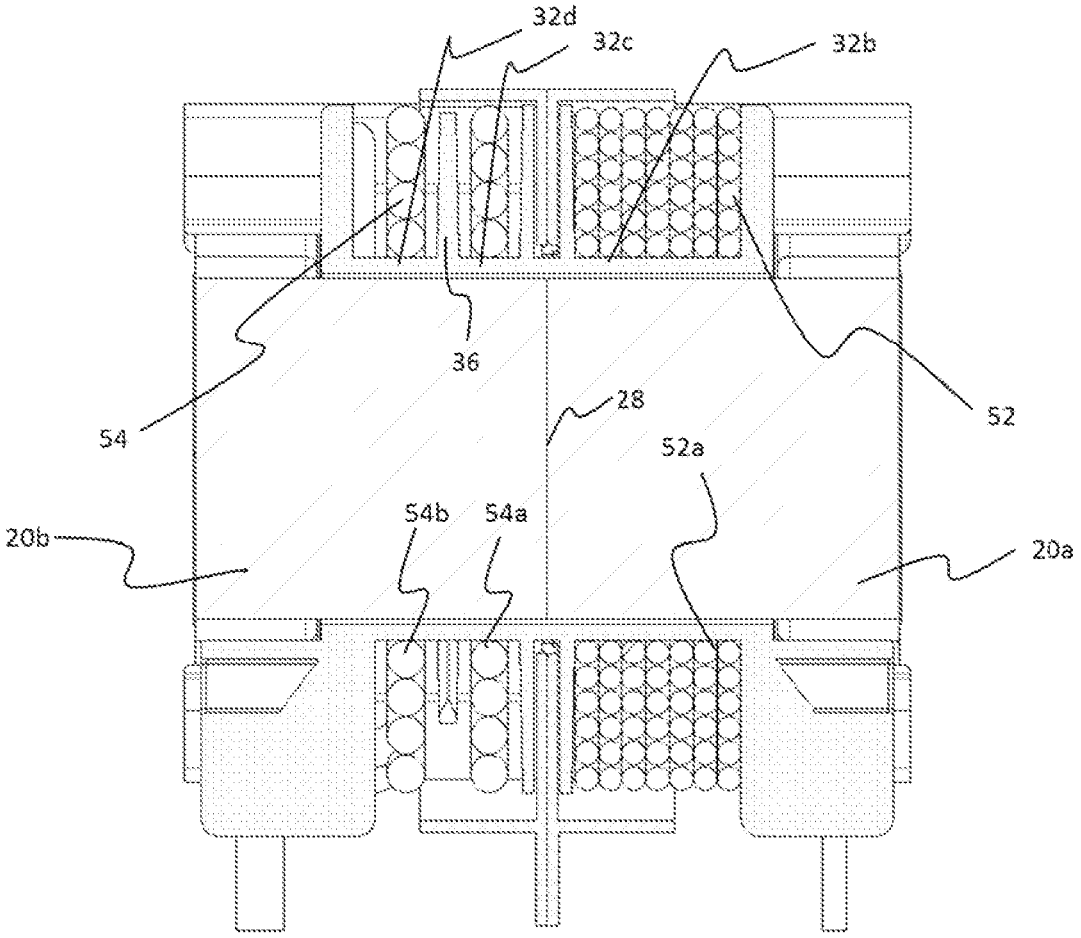
FIG. 5 is a cross-sectional view taken along a plane perpendicular to the mounting surface and passing through the center of the coil axis in the coil device shown in FIG. 1.

FIG. 4 is a cross-sectional view taken along a plane on which the second partition in the coil device shown in FIG. 1 is located. FIG. 5 is a cross-sectional view taken along a plane perpendicular to the mounting surface and passing through the center of the coil axis in the coil device shown in FIG. 1. As shown in FIGS. 4 and 5, the coil body 50 is wound around the hollow cylindrical portion 32 of the bobbin 30. The coil body 50 has a first winding portion 52 and a second winding portion 54. The first winding portion 52 is wound around the outer peripheral surface 32*b* of the hollow cylindrical portion 32 provided between the first partition portion 35 and the first flange portion 34*a*; the second winding portion 54 is wound around the outer peripheral surfaces 32*c*, 32*d* of the hollow cylindrical portion 32 provided between the first partition portion 35 and the flange portions 34*b*, and is wound around both sides of the second partition portion 36 at the predetermined positions. Further, the second winding portion is wound by, for example, a plurality of windings. By adopting such a configuration, the magnetic coupling on the side of the second winding portion 54 can be reinforced. The second partition portion 36 has an opening portion 36*g* capable of winding the second winding portion 54 around both sides of the second partition portion 36 at a predetermined position. The opening portion 36*g* is provided, for example, on the mounting surface side. Thus, the second winding portion 54 can be easily wound at a predetermined position, and the magnetic coupling on the side of the second winding portion 54 can be reinforced. Also, since the second winding portion 54 is wound at a predetermined position when the coil device 10 is mass-produced, the leakage inductance manufacturing error between the primary side and the secondary side due to the difference in the secondary side winding of each coil device 10 is effectively controlled or reduced, while strengthening the magnetic coupling on the side of the second winding portion. Further, in the coil device 10, the second partition portion 36 has the opening portion 36*g* capable of winding the second winding portion 54 around the both sides of the second partition portion 36 at a predetermined position, and by adopting such a configuration, the second winding portion 54 can be easily wound on both sides of the second partition portion 36 according to a predetermined position, without causing high elevation of the coil due to wire extraction.

The coil device 10 can be manufactured, for example, in the following steps. First, the bobbin 30 having the first partition portion 35 and the second partition portion 36 formed on the outer peripheral surface as shown in FIG. 1 is prepared. The bobbin 20 is manufactured, for example, by resin molding or the like.

Next, the first winding portion 52 is formed on the outer peripheral surface 32*b* of one side of the first partition portion 35. For example, the inner winding layer 52*a* of the first winding portion 52 is wound around the outer peripheral surface 32*b* of the hollow cylindrical portion 32. Thereafter, the other layers of the first winding portion 52 are continuously wound on the inner winding layer 52*a*.

Next, the second winding portion 54 is formed on the outer peripheral surfaces 32*c*, 32*d* on the other side of the first partition portion 35. Further, the second winding portion 54 may be formed after the first winding portion 52 is formed on the outer peripheral surface 32*a* of one side of the first partition portion 35. The inner winding layers 54*a*, 54*b* of the second winding portion 54 are wound around the outer peripheral surfaces 32*c*, 32*d* of the hollow cylindrical portion 32. In this case, for example, any turns of winding 54*a* of the second winding portion 54 may be wound around the one side of the second partition portion 36 from the first partition portion 35 on one side of the second partition portion 36, and any turns of the winding 54*b* of the second winding portion 54 may be wound around the other side of the second partition portion 36, then the winding of the inner winding layers 54*a*, 54*b* is completed. Thereafter, the other layers of the first winding portion 52 are continuously wound on the inner winding layers 54*a*, 54*b*. In the example shown in FIG. 5, the inner winding layers 54*a*, 54*b* are wound one turn around each of the outer peripheral surfaces 32*c*, 32*d*, but are not limited thereto, and may be wound more turns according to the width of the winding wire and the outer peripheral surfaces 32*c*, 32*d*.

Further, in the above-described example, the winding method in which the inner winding layers 54*a* and 54*b* are respectively wound around the outer peripheral surfaces 32*c* and 32*d* on both sides of the second partition portion 36 has been described, but the present invention is not limited thereto. Alternatively, the inner winding layer 54*a* and the outer winding layer thereon are wound around the outer peripheral surface 32*c* on one side of the second partition portion 36. Thereafter, the inner winding layer 54*b* and the outer winding layer thereon are wound around the outer peripheral surface 32*d* on the other side of the second partition portion 36. By such a method, the second winding portion 54 can also be wound at a predetermined position, thereby effectively controlling or reducing the leakage inductance manufacturing error between the primary side and the secondary side due to the difference in the secondary side winding of each coil device 10. Further, the inner winding layers 54*a*, 54*b* herein may also be wound around the outer peripheral surfaces 32*c*, 32*d* with more turns.

Further, in the example described above, the second winding portion 54 is wound from the first partition portion 35, but the present invention is not limited thereto, and the winding may be started from the second flange portion 34*b*.

Other Embodiments

The coil device according to the present invention is not limited to the above embodiments, and various modifications may be added without departing from the scope of the present invention. For example, the magnetic core 20 is not limited to the core joining the two substantially symmetrical core portions 20*a* and 20*b*, and one of the core portions may have a flat shape, and the position of the center gap 28 can be set to any position in the Z direction. In addition, the number of turns of each part included in the coil body 50 can be appropriately changed.

DESCRIPTION OF SYMBOLS

10 coil device
20 magnetic core
22 shaft portion
28 central gap
30 bobbin
32 hollow cylindrical portion
32*a* through hole
38*a*-38*h* terminal portion
50 coil body

What is claimed is:

1. A coil device, comprising:

a bobbin including a hollow cylindrical portion, a first flange portion at a first end of the hollow cylindrical portion, a second flange portion at a second end of the hollow cylindrical portion, a first partition portion between the first flange portion and the second flange portion and a second partition portion between the first partition portion and the second flange portion on the hollow cylindrical portion;

a first winding portion wound around an outer peripheral surface of the hollow cylindrical portion between the first partition portion and the first flange portion;

a second winding portion wound around (i) the outer peripheral surface of the hollow cylindrical portion between the first partition portion and the second flange portion and (ii) both sides of the second partition portion;

a mounting surface configured to be mounted on a substrate; and a first support member and a second support member that are inserted into the bobbin and the first and second winding portions opposite to each other, wherein:

the first partition portion includes a first wall and a second wall on the outer peripheral surface;

the first wall and the second wall are spaced along the hollow cylindrical portion such that there is a gap between the first wall and the second wall along the hollow cylindrical portion;

the first support member and the second support member are insertable into the gap between the first wall of the first partition portion and the second wall of the first partition portion to be mated to each other;

the second partition portion has an opening that opens towards the mounting surface;

each of the first support member and the second support member has a top L-shaped plate when viewed in a direction perpendicular to the mounting surface;

the top L-shaped plate of the first support member and the top L-shaped plate of the second support member are interlaced when viewed in the direction perpendicular to the mounting surface;

the top L-shaped plates have overlapping portions that overlap when viewed in the axial direction of the hollow cylindrical portion;

at least a quarter of an outer circumference of the hollow cylindrical portion is in the opening; and a width of the opening is larger than a width of the overlapping portions when viewed in the axial direction.

2. The coil device according to claim 1, further comprising:

a first core portion and a second core portion that are inserted into the hollow cylindrical portion, wherein:

each of the first core portion and the second core portion comprises a central shaft portion, a side leg portion and a connecting portion that connect the shaft portion and the side leg portion, each of the first support member and the second support member comprises a flange portion for positioning the side leg portion, and the flange portion restricts the displacement of the first core portion and the second core portion in a direction that the first core portion and the second core portion oppose each other.

3. The coil device according to claim 1, wherein:

each of the first support member and the second support member has an insulating wall extending between the first winding portion and the second winding portion in a direction toward the mounting surface of the coil device; and the depth of the insulating wall extends to the mounting surface.

4. The coil device according to claim 1, wherein:

the first support member and the second support member have the same shape.

5. The coil device according to claim 1, wherein:

there is a gap between the first core portion and the second core portion.

6. The coil device according to claim 1, wherein:

the second winding portion is wound by multi-strand wire winding.

7. A method of manufacturing the coil device of claim 1, comprising:

preparing the bobbin having the first partition portion and the second partition portion on the outer peripheral surface;

forming the first winding portion on the outer peripheral surface of one side of the first partition portion, and forming the second winding portion on both sides of the second partition portion on the outer peripheral surface on the other side of the first partition portion.

8. A method of manufacturing the coil device according to claim 7, wherein in the process of forming the second winding portion on both sides of the second partition portion, winding the second winding portion in turn on one side and the other side of the second partition portion.

* * * * *